US005124685A

United States Patent [19]

Rankin

[11] Patent Number: 5,124,685

[45] Date of Patent: Jun. 23, 1992

[54] SECURITY DEVICE WITH RETRACTABLE TETHER

[75] Inventor: Alexander Rankin, Bedminster, Pa.

[73] Assignee: Vulcan Spring and Manufacturing Co., Telford, Pa.

[21] Appl. No.: 737,409

[22] Filed: Jul. 29, 1991

[51] Int. Cl.[5] ..... G08B 13/14

[52] U.S. Cl. ..... 340/568; 340/665; 340/548; 200/61.13; 200/61.18

[58] Field of Search ..... 340/568, 651, 652, 665, 340/687, 548; 200/61.13, 61.18

[56] References Cited

U.S. PATENT DOCUMENTS

| | | | |
|---|---|---|---|
| 4,069,919 | 1/1978 | Fernbaugh | 340/568 |
| 4,616,113 | 10/1986 | Jank et al. | 340/568 |
| 4,698,615 | 10/1987 | Wilber | 340/568 |
| 4,766,419 | 8/1988 | Hayward | 340/568 |
| 4,772,878 | 9/1988 | Kane | 340/568 |
| 4,821,025 | 4/1989 | Ross, Sr. | 340/568 |
| 4,855,719 | 8/1989 | Posey | 340/568 |
| 4,896,140 | 1/1990 | Biever et al. | 340/568 |
| 4,945,341 | 7/1990 | Buttimer | 340/568 |

FOREIGN PATENT DOCUMENTS

| | | | |
|---|---|---|---|
| 699180 | 12/1964 | Canada | 200/61.13 |
| 2128790 | 5/1984 | United Kingdom | 340/568 |

OTHER PUBLICATIONS

Protex Security Systems, Inc. announcement entitled *Securax-Secure-Cam*, one page, Nov. 1987.

Protex Security Systems, Inc. announcement entitled *Merchant Guard MG-1*, 3 pages, Nov. 1987.

*Primary Examiner*—Jin F. Ng
*Assistant Examiner*—Christine K. Oda
*Attorney, Agent, or Firm*—Howson and Howson

[57] ABSTRACT

A security device for deterring theft of articles of merchandise displayed for customer handling and demonstration. A cable is attached to an article and is extendable under tension from a storage reel attached to a store fixture. A switch adjacent to the reel is held in one of two operative positions by the cable stretching across an actuator arm of the switch. If the cable is severed or cut, as by a thief intending to steal the article, the storage reel retracts the cable past the actuator arm causing the switch to change to the other position and actuate an alarm.

6 Claims, 3 Drawing Sheets

FIG. 3
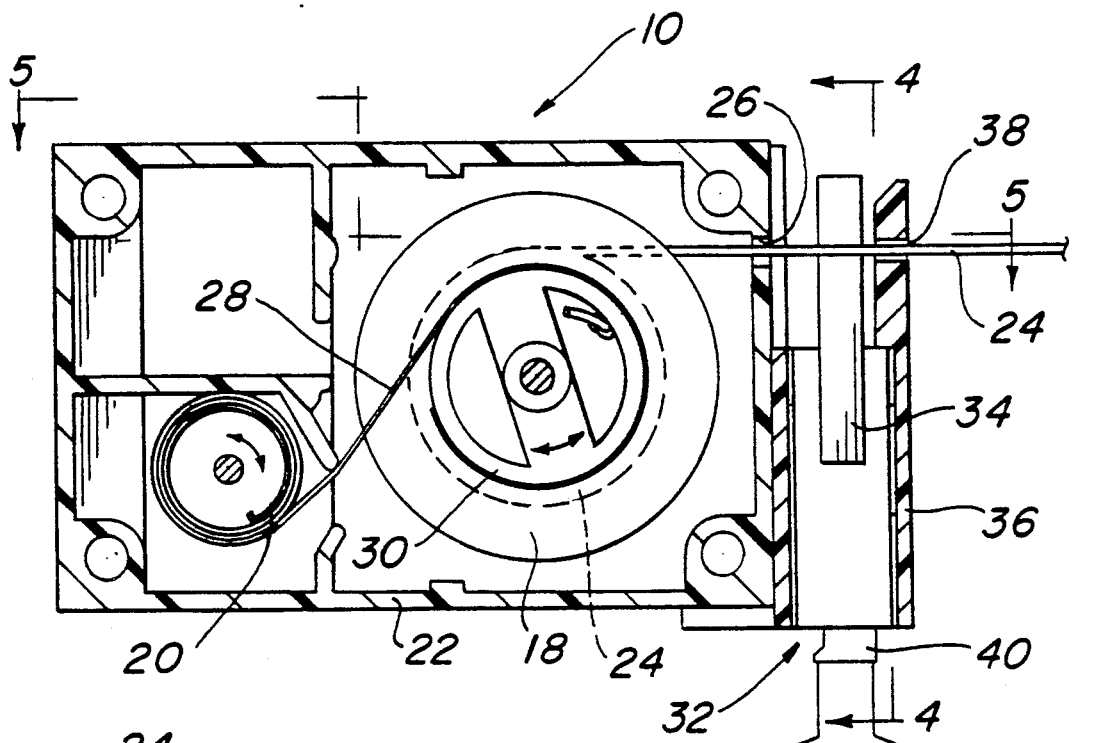
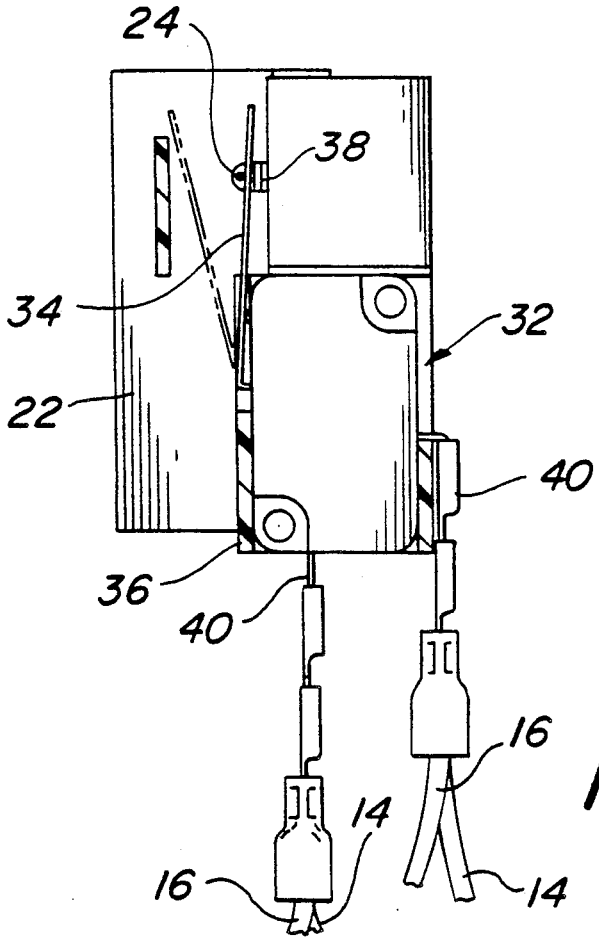
FIG. 4

SECURITY DEVICE WITH RETRACTABLE TETHER

BACKGROUND OF THE INVENTION

The present invention relates generally to security devices, and more particularly to security devices for deterring theft of articles of merchandise displayed for customer handling and demonstration.

Articles of merchandise such as electronic and optical instruments, computers, outer garments and similar portable items are often openly displayed on store shelves and racks in a manner which invites customers to handle and inspect them before deciding to make a purchase. Such items are especially vulnerable to shoplifting. Consequently a panoply of security systems have been proliferated for instantly detecting and alerting store personnel when a theft is in progress. Unfortunately, as quickly as new systems are devised, the more cunning and experienced shoplifters find ways of defeating or neutralizing them. Less defeasible systems are possible, of course, but usually involve initial costs and maintenance expenses disproportionately higher than the value of the goods being protected.

The simplest security measure, short of displaying the goods behind locked glass panels accessible only in the presence of a salesperson, is to tether the goods from a display fixture with a relatively unbreakable chain or flexible wire cable. An improvement on this concept is the Vulcan Pullbox ® manufactured by Vulcan Spring and Manufacturing Company, Telford, Penna. It includes a retractable cable designed especially for point-of-purchase applications where the merchandise can be demonstrated by the salesperson or easily handled by the customer while at the same time the product is held captive to the fixture on which it is displayed. A spring-biased reel provides a retracting force throughout the full extension of the cable to take up any slack which might otherwise entangle with itself or other articles.

Unfortunately, a tethered cable or chain does not thwart the more insolent and brazen shoplifter from cutting the cable or chain. Countermeasures which alert the shopkeeper when this occurs have been used or suggested. For example, U.S. Pat. No. 4,069,919 to Fernbaugh discloses a tether of electrical conductors which complete an alarm circuit. When the circuit is broken, as by cutting the cable, the alarm is energized. U.S. Pat. No. 4,772,878 to Kane, U.S. Pat. No. 4,896,140 to Biever et al, and U.S. Pat. No. 4,616,113 to Jank et al disclose tethers formed of electrical conductors which also sound an alarm if they are electrically shorted in addition to if they are cut. In each of these devices the tether conducts electricity. As a precaution against electrical shock to customers handling the product, they must be carefully insulated and routinely inspected for exposed wires. Electrically conductive tethers are therefore extremely limited in application.

U.S. Pat. No. 4,698,617 to Wilbur discloses a non-electrical tie-down cord which mechanically actuates an electrical switch in a separate alarm circuit when excessive tension is applied to the cord. However, the alarm is not activated if the cord is cut or disconnected.

SUMMARY OF THE INVENTION

Accordingly, it is an object of the present invention to provide a novel and improved security device which will deter theft of an article of merchandise openly displayed for permitting a salesperson or customer to handle with ease for demonstration and inspection.

Another object of the invention is to provide a security device having a retractable tether which will not interfere or entangle with adjacent merchandise or other tethers, and which is suitable for actuating an alarm if the extendable end of the tether is severed.

Still another object is to provide a reliable security device having a tether which will enable a person to handle an attached article without danger of electrical shock, which is relatively easy to install and maintain, and which is suitable for use with a plurality of such devices gang operating a single alarm.

These and other objects of the security device according to the invention are achieved by a cable attached at one end to an article and extendable under tension from a storage reel attached to a stationary fixture. A switch adjacent to the reel is held in one of two operative positions by the cable stretching across an actuator arm of the switch. If the cable is severed or cut, as by a thief intending to remove the article, the storage reel retracts the cable past the actuator arm causing the switch to change to the other operative position and actuate an alarm.

BRIEF DESCRIPTION OF THE DRAWINGS

For a better understanding of these and other objects and aspects of the invention, reference will be made to the following detailed description taken in conjunction with the accompanying drawings.

FIG. 3 is a sectional view of the security device taken in a plane along line 3—3 of FIG. 2;

FIG. 4 is a sectional view of the security device taken in a plane along line 4—4 of FIG. 3;

DESCRIPTION OF THE PREFERRED EMBODIMENT

Figure 1:
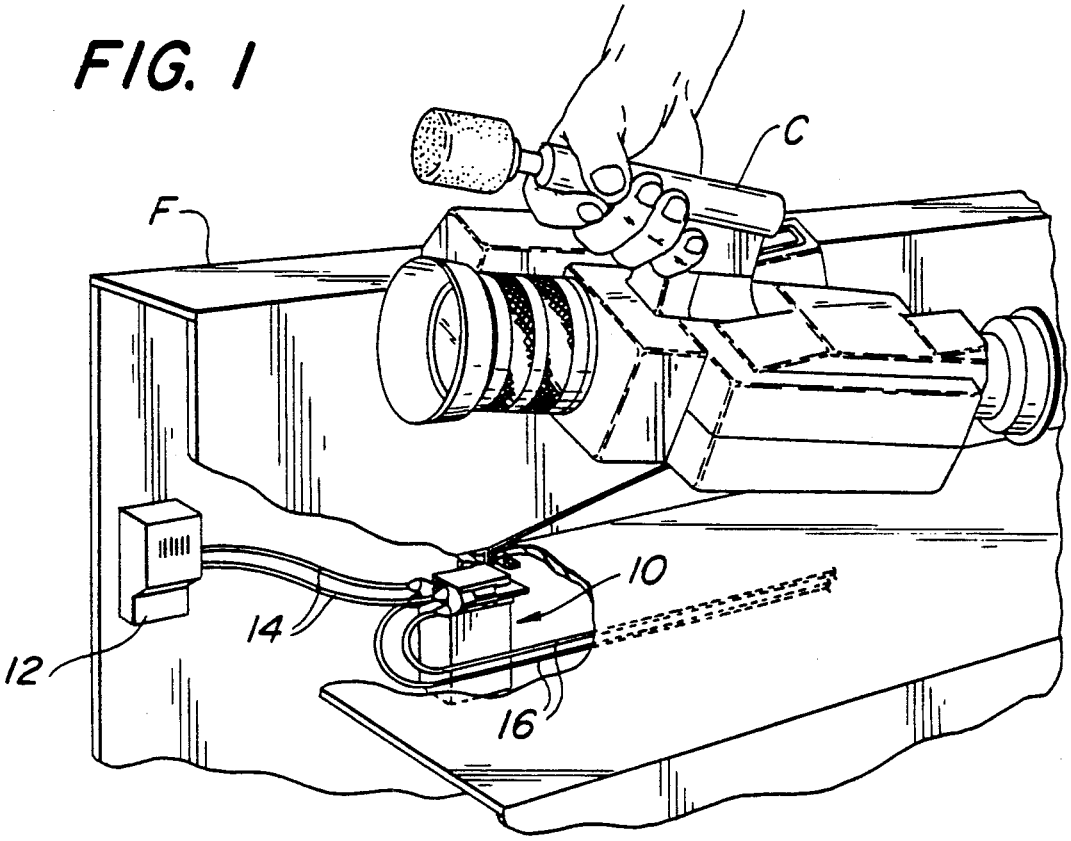
FIG. 1 is a perspective view of a video camera tethered to a security device according to the invention, the device being hidden behind a merchandise display fixture.
Figure 2:
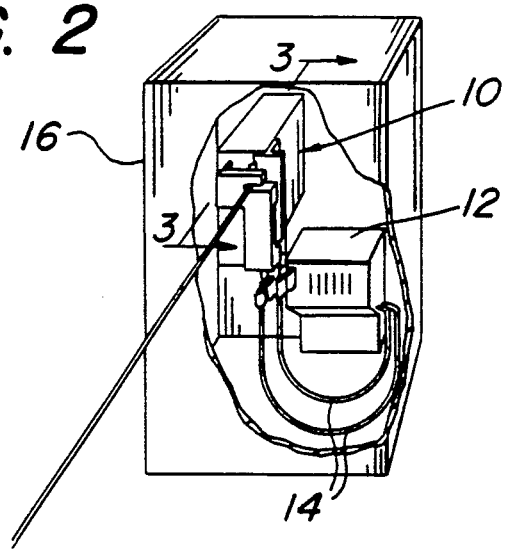
FIG. 2 is a perspective view of the security device enclosed within a housing for mounting on a vertical merchandise display panel.
Figure 5:
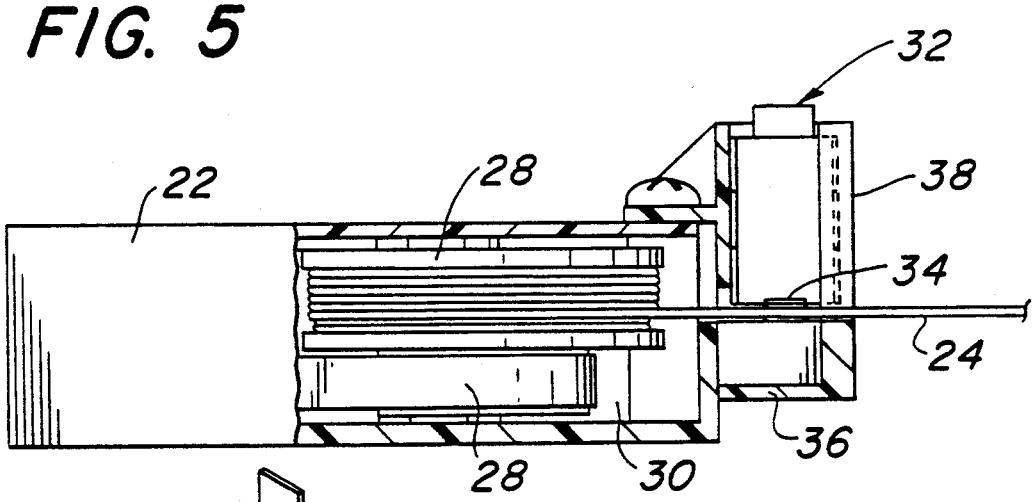
FIG. 5 is a sectional view of the security device taken in planes along line 5—5.
Figure 6:
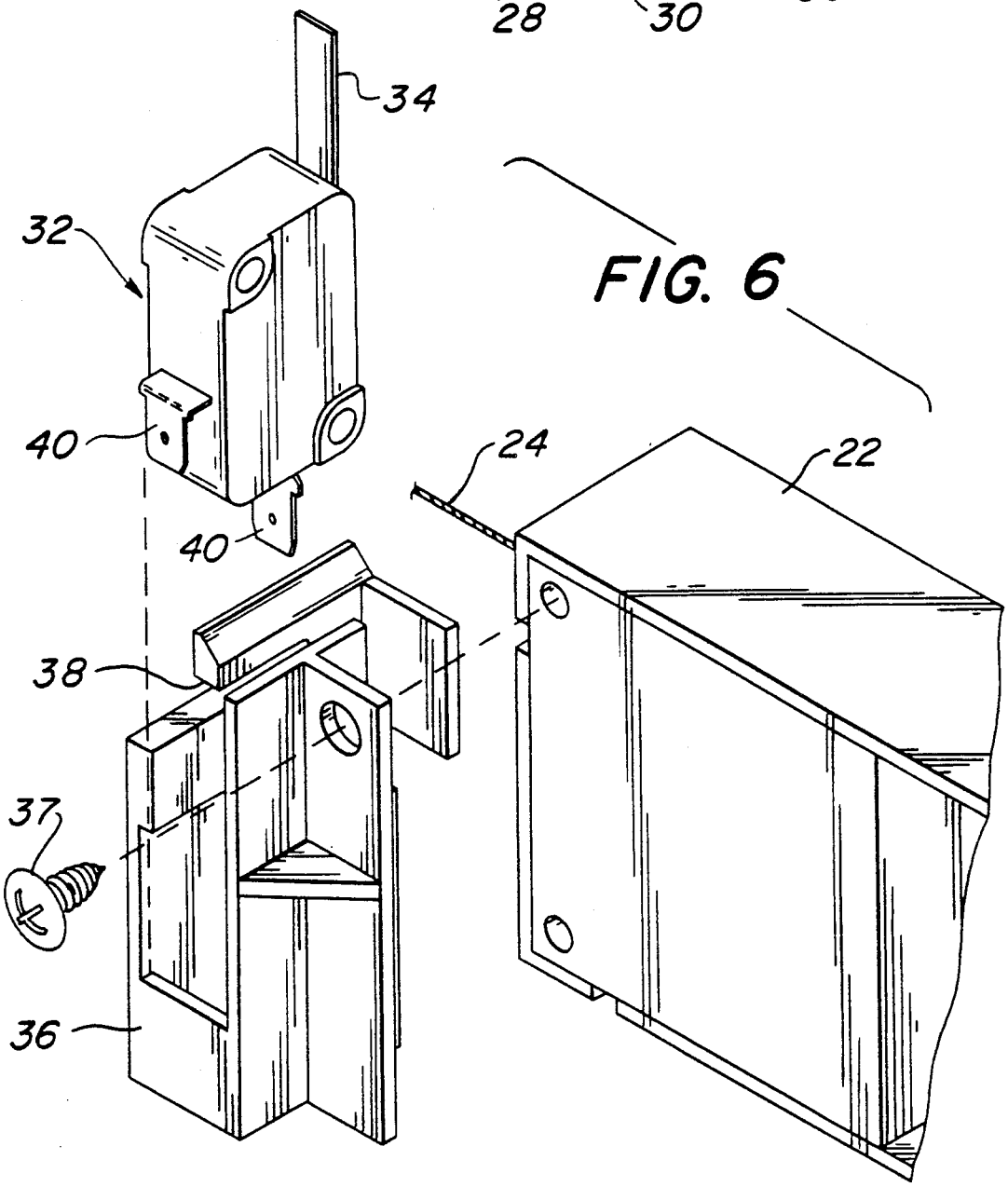
FIG. 6 is an exploded isometric view of a portion of the security device.

Referring now to the drawings wherein like characters designate like or corresponding parts throughout the several views, FIG. 1 shows a demonstration model of a video camera C being lifted from the shelf of a merchandise display fixture F. The distance the camera can be removed from the shelf is limited by a retractable tether or cable of a security device 10 which is preferably hidden from view within or behind fixture F. An audible alarm and power supply module 12, inaccessible to the customer and electrically connected to device 10 by wires 14, alerts the merchant when the cable is cut. Additional devices 10, operating from the same alarm and power supply module 12, may similarly tether other articles of merchandise and be connected in parallel by wires 16 as shown, or in series as described below. FIG. 2 illustrates another application for a sample article tethered to a security device 10 enclosed within a housing 16 suitable for mounting on a vertical display fixture.

As best seen in FIGS. 3–6, security device 10 includes a cable reel 18 and a spring hub 20 rotatably supported on parallel axes in a housing 22. Components of device 10, such as the housing, cable reel and spring hub, are preferably precision manufactured of a high impact plastic such as polystyrene. A cable 24, fixed at one end to cable reel 18 and formed at the other end for connecting to the article of merchandise, passes through an aperture 26 into housing 22 as it winds on and off of cable reel 18. Cable 24 is preferably constructed of a flexible steel with an end fitting suitable for positive security attachment to the article. The cable length is typically about five feet long to allow sufficient latitute of movement of the article from its displayed position.

In the illustrated embodiment, cable 24 is retracted onto reel 18 by a resilient means which includes a constant-force spring 28 fixed at the inner end to the periphery of spring hub 20 and at the outer end to the periphery of a cylindrical flange 30 which coaxially extends from the side of cable reel 18 and rotates therewith. Spring 28 winds in opposite directions onto reel 18 and flange 20. That is, as spring 28 unwinds from hub 20, it winds onto flange 30, and vice versa. A permanent inward camber relative to hub 20 along the length of spring 28 produces a torque on cable reel 18 in a direction which retracts cable 24 with substantially constant pull throughout its full extension.

A detector means includes a spring-actuated two-position switch 32 is mounted on housing 22 adjacent to the outlet of aperture 26 for detecting the presence of cable 24. Switch 32 is preferably a conventional precision, snap-acting type operated by a cantilevered actuator arm 34 with terminals 40 for connecting to wires 14, and optionally to wires 16. An adaptor 36 secured to housing 28 by a fastener 37 retains switch 32 with arm 34 compressed against the side of cable 24 to maintain switch 32 in an electrically "armed" position. In the embodiment of FIG. 1, for instance, switch 32 is spring-biased in a normally-closed position, but is held open by cable 24 acting against arm 34. Where multiple security devices 10 operate from a single alarm, the switches 32 would be electrically connected in parallel. Cutting any one cable 24 or short circuiting wires 14 or 16 will activate the alarm.

In some multiple device applications it may be desirable to utilize a switch arrangement which maintains a continuous current through each device 10 while in the latent or "armed" state in order to continuously monitor circuit continuity. In this case, switches 32 would be spring-biased in a normally-open position and be electrically connected in series. Thus, any cut cable 24 or a discontinuity in the electrical circuit will operate a relay to energize the alarm.

Cable 24 is confined at the outlet of aperture 26 for traversing arm 34 in a direction across its width regardless of the direction the extended end of cable 24 is pulled. This is accomplished by a slot 38 in adaptor 36 spaced from aperture 26 and extending normal to the length of actuator arm 34. One end is open for admitting cable 24 and the other end terminates opposite of aperture 26.

Operation of security device 10 is best described with reference to FIGS. 3 and 4. With housing 22 secured to a merchandise display fixture, cable 24 extends from reel 18 across actuator arm 34 between aperture 26 and slot 38 and connects at its extended end to an article of merchandise. Spring 28 applies a constant torque to reel 18 and tension in cable 24 to hold switch 32 in a latent or "armed" state. As the article is moved relative to housing 22 for inspection or demonstration, spring 28 allows reel 18 to pay out or take up cable 24 under tension across arm 34 without entanglement with itself or other displayed articles. However, if the extended end of cable 24 is severed, the pulling resistance of the article is removed allowing the uncut portion of the cable to quickly retract onto reel 18. When this happens, lateral resistance of cable 24 releases actuator 34 allowing switch 32 to operate an alarm and alert store personnel.

Some of the many advantages of the invention should now be readily apparent. For example, a security device is provided which allows sample merchandise to be lifted from a display fixture for handling, demonstrating or inspection with risk of being stolen. The device utilizes a tether-type cable which will not entangle with adjacent merchandise, and will actuate an alarm if the cable is severed from the merchandise. There is no danger of electric shock to persons handling the merchandise due to faulty wiring because the cable does not form part of an electrical detection circuit. A plurality of such devices may be connected in series or parallel to operate a single alarm.

It will be understood that various other changes in the details, steps and arrangement of parts, which have been herein described and illustrated in order to explain the nature of the invention, may be made by those skilled in the art within the principal and scope of the invention as expressed in the appended claims.

I claim:

1. A security device for deterring theft of openly displayed articles from a fixture, comprising:

a support formed to be secured to the fixture;

a cable connected at one end to said support and formed to be connected at the other end to the article;

resilient means operatively connected between said support and said cable for retracting said cable toward said support;

guide means fixed adjacent to said support for preventing lateral displacement of a portion of said cable extended from said support; and detector means operable in response to severance of said cable for actuating an alarm, said detector means including an electrical switch fixed to said support and biased to an alarm-actuating position, and an actuator arm connected to said switch and urged against the side of the extended portion for withholding said switch from said position.

2. The security device according to claim 1 further comprising:

a reel rotatable on said support for storing said cable;

a hub rotatable on said support on an axis parallel to the rotatable axis of said reel; and said retracting means including a spring fixed at the inner end to the periphery of said hub and at the outer end to said reel for winding in opposite directions onto said hub.

3. The security device according to claim 1 wherein said guide means further comprises:

apertures on opposite sides of said actuator arm for retaining the extended portion of said cable in tension substantially normal to the length of said arm.

4. A device for tethering a first member from a second member, comprising:

a cable having opposed ends for connecting to the respective members;

resilient means connected to said cable for connecting to the second member for imparting tension to a portion of said cable extended from the second member;

guide means for connecting to the second member and for limiting displacement of the extended portion in all lateral directions therefrom; and detector means operatively connected to the extended portion for signalling severance of the cable from the second member, said detector means including an electrical switch having an actuator arm urged against the side of the extended portion.

5. A device for tethering a first member from a second member, comprising:

a cable having opposed ends for connecting to the respective members;

resilient means connected to said cable to be connected for connecting to the second member for imparting tension to a portion of said cable extended from the second member;

guide means for connecting to the second member and for limiting lateral displacement of the extended portion;

detector means operatively connected to the extended portion for signalling severance of the cable from the second member, said detector means including an electrical switch having an actuator arm urged against the side of the extended portion; and wherein said resilient means further comprises a reel formed to rotate on said second member for storing said cable, and a cylindrical flange coaxially extending from one side of said reel, a hub formed to rotate on the second member on an axis parallel to the axis of rotation of said reel, and a spring member fixed at one end thereof to the periphery of said hub and at the other end to the periphery of said flange for winding in opposite directions onto said hub and said flange.

6. In a security device for deterring theft of openly displayed articles from a fixture, the device including a cable retractable under tension on a reel, the improvement comprising:

detector means mounted on said device and operable in response to severance of the cable for actuating an alarm, said detector means including an aperture for limiting the lateral displacement of an extended portion of the cable in tension, an electrical switch biased in one of two positions, and an actuator arm urged against the side of the extended portion for holding the switch in an other of said positions.

* * * * *